United States Patent [19]

Hopkins

[11] 4,203,624

[45] May 20, 1980

[54] WRITING TABLET

[75] Inventor: Richard B. Hopkins, Pennsburg, Pa.

[73] Assignee: Knoll International, Inc., Greenwich, Conn.

[21] Appl. No.: 943,111

[22] Filed: Sep. 18, 1978

[51] Int. Cl.[2] ..... A47B 39/00; A47B 11/00

[52] U.S. Cl. ..... 297/162; 108/142

[58] Field of Search ..... 297/162, 154, 155, 417, 297/433, 116; 108/142; 248/418, 430

[56] References Cited

U.S. PATENT DOCUMENTS

| | | | |
|---|---|---|---|
| 1,547,849 | 7/1925 | Boogaard et al. | 108/142 |
| 1,781,015 | 11/1930 | Keipp | 108/142 |
| 2,650,648 | 9/1953 | Nordmark et al. | 248/418 |
| 3,197,254 | 7/1965 | Hendrickson | 297/162 |
| 3,292,972 | 12/1966 | Krueger | 297/162 |
| 3,547,488 | 12/1970 | Barnes | 297/154 X |
| 3,598,442 | 8/1971 | Miller | 297/162 |

FOREIGN PATENT DOCUMENTS

| | | | |
|---|---|---|---|
| 609684 | 9/1960 | Italy | 297/162 |
| 816467 | 7/1969 | United Kingdom | 297/162 |

*Primary Examiner*—James T. McCall
*Attorney, Agent, or Firm*—Robert Scobey

[57] ABSTRACT

A writing tablet for a chair arm is mounted by a pivot swivel block to the arm for pivotal movement about a first axis. A tablet panel support is mounted to the pivotal swivel block for pivotal movement about a second axis perpendicular to the first axis. Semicircular slots are included in the pivot swivel block and tablet panel support in registry with each other, and a ball rides in the slots to limit the movement of the tablet panel support about the second axis.

7 Claims, 5 Drawing Figures

WRITING TABLET

BACKGROUND AND BRIEF DESCRIPTION OF THE INVENTION

This invention relates to writing tablets, and particularly provides a writing tablet to be mounted to a chair arm or the like for pivotal movement about two axes. Writing tablets of this type are known, although most involve cumbersome and complicated structures. In the present invention, pivotal movements are carried out with simply a few parts, and the writing tablet structure is easily fabricated and easily assembled.

The following patents are representative of the prior art in this field:

| U.S. Pat. No. | Issue Date | Patentee |
|---|---|---|
| 957,552 | May 10, 1910 | Gordon |
| 1,093,686 | Apr. 21, 1914 | Cogger |
| 1,648,717 | Nov. 8, 1927 | Blitz et al |
| 3,353,866 | Nov. 21, 1967 | Chapman et al |
| 3,547,488 | Dec. 15, 1970 | Barnes |
| 3,598,442 | Aug. 10, 1971 | Miller |

In the present invention, a pivot swivel block along with a tablet panel support is utilized. The pivot swivel block is mounted to a chair arm or the like for pivotal movement about a first axis; the tablet panel support is mounted to the pivot swivel block for pivotal movement about a second axis perpendicular to the first axis. Opposed semi-circular slots are included in the pivot swivel block and tablet panel support, and a ball riding in these slots limits the movement of the tablet panel support about the second axis. A writing tablet is mounted to the tablet panel support, and thus achieves total movement into and out of use positions by virtue of the two axes of movement.

A more complete understanding of the invention will be obtained by reference to the following detailed description, taken in conjunction with the drawings.

DETAILED DESCRIPTION

Figure 1:
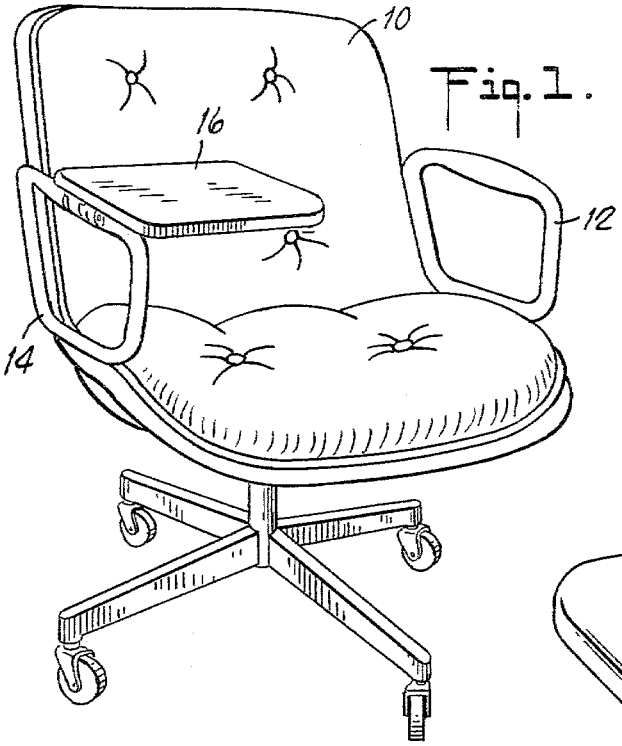
FIG. 1 is a perspective view of a chair and writing tablet in accordance with the invention.

Referring to FIG. 1, a chair 10 is shown having arms 12 and 14. A writing tablet 16 is shown mounted to the arm 14. The details of the mounting of the writing tablet 16 to the arm 14 are shown, in exploded view, in FIG. 2.

Figure 2:
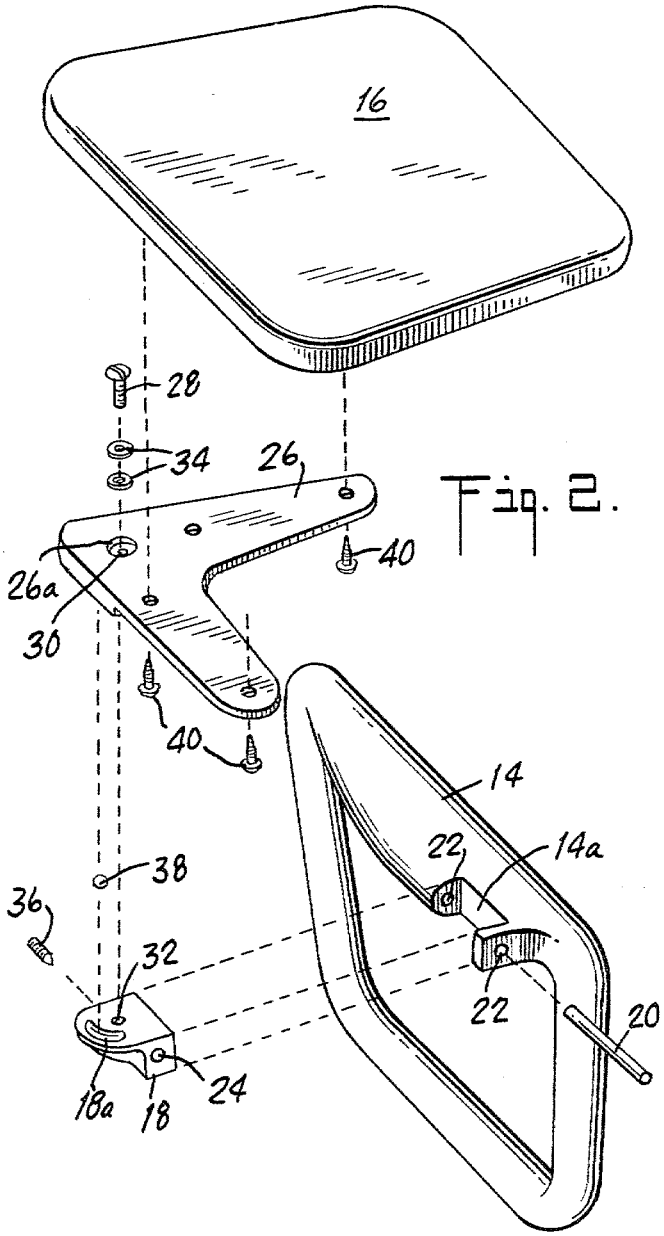
FIG. 2 is an exploded view of the writing tablet assembly of FIG. 1.
Figure 4:
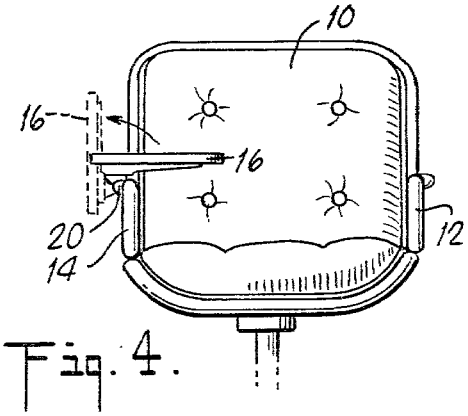
FIGS. 4 and 5 are front and side views illustrating the movements of the writing tablet of FIG. 1.

With reference to FIG. 2, the chair arm 14 includes a cutout portion 14*a*. A pivot swivel block 18 is adapted to be positioned within the cut-out portion 14*a*, and held in place by a roll pin 20 which passes through holes 22 in the arm 14*a* and through a corresponding hole 24 in the pivot swivel block 18. In this fashion, the pivot swivel block 18 is mounted to the chair arm 14 for pivotable movement about a first axis. That first axis is constituted by the longitudinal axis of the roll pin 20. The roll pin permits pivotal movement of the writing tablet 16 about the axis constituted by the roll pin as shown in FIG. 4 (note the movement of the writing tablet 16 between the position shown in full lines and the dashed line position).

Figure 3:
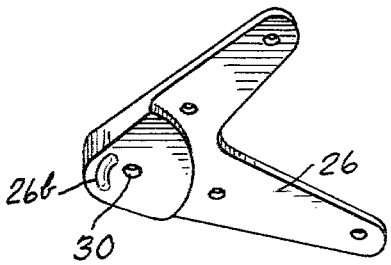
FIG. 3 is a perspective view of a tablet panel support useful in the invention.

A tablet panel support 26 (FIGS. 2 and 3) is included. The tablet panel support is mounted to the pivot swivel block 18 through use of a machine screw 28 which passes through hole 30 in the tablet panel support and is threaded into threaded hole 32 in the pivot swivel block 18. Two spring washers 34 may be employed, seated in a recess 26*a* in the tablet panel support 26 through which the machine screw 28 passes. These spring washers, which may be positioned so that their curvatures are opposed to each other to provide for maximum spring action, yieldably bias the tablet panel support 26 and the pivot swivel block together. A set screw 36 may be employed which is threaded into the pivot swivel block 18 and which engages the machine screw 28 to hold the machine screw in its position with a particular biasing force between the tablet panel support 26 and pivot swivel block 18.

The underside of the tablet panel support 26 includes a semi-circular slot 26*b* therein. The pivot swivel block 18 similarly includes a semi-circular slot 18*a* therein. These two slots are in opposition to each other, and a ball 38 rides in the slots, held in place by virtue of the yieldable biasing of the tablet panel support and the pivot swivel block toward each other. It is thus apparent that the tablet panel support 26 is pivotally mounted to the pivot swivel block 18 for pivotal movement about a second axis which is perpendicular to the axis first mentioned above. The second axis is constituted by the longitudinal axis of the machine screw 28, while the first axis is constituted by the longitudinal axis of the roll pin 20. The pivotal movement of the tablet panel support 26 with respect to the pivot swivel block 18 is as shown in FIG. 5 (note the movement of the writing tablet 16 from the position shown in full lines to that shown in dashed lines).

The writing tablet 16 is secured to the tablet panel support 26 by means of screws 40 which pass through the tablet panel support 26 and into the writing tablet 16.

Figure 5:
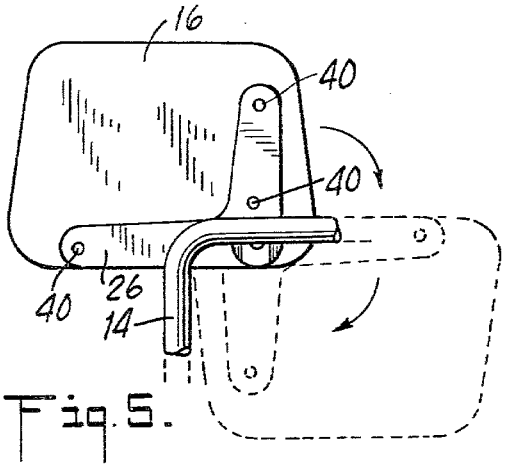

There is thus provided a unique writing tablet mechanism capable of movement about two axes perpendicular to each other, to give full movement of the writing tablet as shown in FIGS. 4 and 5. The structure is simple, and by virtue of the opposed semi-circular slots 18*a* and 26*b*, any degree of movement may be provided as limited by the ball 38 riding in these slots. Use of two 90° slots will result in 180° of movement of the writing tablet about the axis of the machine screw 28.

Because modifications of the presently preferred embodiment described above will suggest themselves to those skilled in this art, the invention should be taken to be defined by the following claims.

What is claimed is:

1. A writing tablet for a chair arm or the like comprising a pivot swivel block, first mounting means for mounting said pivot swivel block to said chair arm or the like for pivotal movement about a first axis, a tablet panel support, second mounting means for mounting said tablet panel support to said pivot swivel block for pivotal movement about a second axis perpendicular to said first axis, a first semicircular slot in said pivot swivel block, a second semicircular slot in said tablet panel support, and a ball riding simultaneously in said slots limiting the amount of movement of said tablet panel support about said second axis.

2. A writing tablet according to claim 1, in which said chair arm or the like includes a cut-out portion which receives a part of said pivot swivel block, and a pin coupling said pivot swivel block to said chair arm or the like for said pivotal movement about said first axis, the longitudinal axis of said pin constituting said first axis.

3. A writing tablet according to claim 1 or 2, in which each of said slots extends for about 90°.

4. A writing tablet according to claim 3, in which said second mounting means includes spring washer means for yieldably biasing said tablet panel support and said pivot swivel block toward each other.

5. A writing tablet for a chair arm or the like comprising a pivot swivel block, first mounting means for mounting said pivot swivel block to said chair arm or the like for pivotal movement about a first axis, a tablet panel support, second mounting means for mounting said tablet panel support to said pivot swivel block for pivotal movement about a second axis perpendicular to said first axis, a first semicircular slot in said pivot swivel block, a second semicircular slot in said tablet panel support, and a ball riding in said slots limiting the movement of said tablet panel support about said second axis, in which said chair arm or the like includes a cut-out portion which receives a part of said pivot swivel block, and a pin coupling said pivot swivel block to said chair arm or the like for said pivotal movement about said first axis, the longitudinal axis of said pin constituting said first axis.

6. A writing tablet according to claim 5, in which each of said slots extends for about 90°.

7. A writing tablet according to claim 6, in which said second mounting means includes spring washer means for yieldably biasing said tablet panel support and said pivot swivel block toward each other.

* * * * *